US007363968B1

(12) United States Patent
Baugh

(10) Patent No.: US 7,363,968 B1
(45) Date of Patent: Apr. 29, 2008

(54) UMBILICAL REEL SAFETY RELEASE

(76) Inventor: Benton Frederick Baugh, 14626 Oak Bend, Houston, TX (US) 77079

( * ) Notice: Subject to any disclaimer, the term of this patent is extended or adjusted under 35 U.S.C. 154(b) by 0 days.

(21) Appl. No.: 11/059,726

(22) Filed: Feb. 17, 2005

(51) Int. Cl.
*E21B 29/12* (2006.01)
*E21B 19/22* (2006.01)

(52) U.S. Cl. ..... 166/77.1; 166/355; 242/157.1

(58) Field of Classification Search ..... 166/77.1, 166/77.2, 355; 242/157.1, 397.3, 396
See application file for complete search history.

(56) References Cited

U.S. PATENT DOCUMENTS 4,410,297 A * 10/1983 Lynch ..... 405/164
4,767,073 A * 8/1988 Malzacher ..... 242/414
5,950,953 A 9/1999 Baugh
6,443,431 B1 * 9/2002 Stasny et al. ..... 254/385

* cited by examiner

*Primary Examiner*—Thomas A Beach

(57) ABSTRACT

The method of preventing over tension to an umbilical wrapped on the spool of an offshore reel when the umbilical is unexpectedly pulled from the spool on the reel, comprising providing a main disk, mounting the main disk on the spool of the reel with a slip connection which will slip at a desired force, connecting motor power for the reel to the main disk, connecting brakes to the main disk, such that when tension from the umbilical exceeds a desired force, the slip connection will slip and prevent the umbilical from being subjected to tension higher than the desired amount.

17 Claims, 4 Drawing Sheets

UMBILICAL REEL SAFETY RELEASE

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The field of this invention of that of umbilical reels which store and handle hose and/or electric and/or fiber optic control lines for deepwater offshore service. These reels typically pay out these lines, called an umbilicals, and mechanics clamp the umbilical to a drilling riser or other pipe string being run to the seafloor. The actual weight of the umbilical is typically supported in the water by the riser or pipe which the umbilical is attached to. Typically these units only reel up the low load of the umbilical, down to the first clamp, and do not have to winch up the whole weight of the cable.

When the drilling riser or other pipe sting is lowered, an operator will rotate the spool to allow umbilical to be paid off in accordance with the downward movement of the riser or pipe. In some cases, the motor can be left in the take up mode, and the umbilical simply be pulled off the spool against the constant tension provided by the motor power.

The spool portion of a reel can typically be locked into position by brakes, the motor, or a manual locking pin.

A danger to the umbilical or reel can occur in the event that the drilling riser or other pipe string that the umbilical is attached to is lowered when the reel spool is locked a in position. The reel spool can be locked in position because someone forgot to release the locking pin, the brakes are set, or the motor is blocked. When this happens, an umbilical worth hundreds of thousands of dollars can be destroyed, or personnel can be hurt.

Alternately, if the riser is running down and the air pressure which runs the reel is lost on the typical reel, the failsafe brakes will automatically lock and there is again a chance of tearing the umbilical in half before the condition is recognized.

A slip clutch has been added to the drive shaft on some reels to prevent the motor from being able to put too much load on the umbilical, potentially damaging it. When the slip clutch is added to the motor drive shaft, it is ineffective in controlling the maximum loading from the brakes which are unaffected by the motor drive shaft slip clutch.

It would be desirable to have a method of allowing the reel spool to slip when the brakes are set or when the motor is locked in position. Typically, it is not desirable to allow the reel spool to slip when the manual locking pin is in place as that the manual locking pin can be used when personnel might be servicing the reel.

BRIEF SUMMARY OF THE INVENTION

This invention provides a method for allowing the reel to have the brakes set and/or the motor locked, but the umbilical can still pay out if the riser or pipe to which the umbilical is clamped begins to be lowered.

A feature of this invention is that if air pressure is lost to the air opened brakes during the lowering process, an automatic safety slip location will be provided.

DETAILED DESCRIPTION OF THE INVENTION

Figure 1:
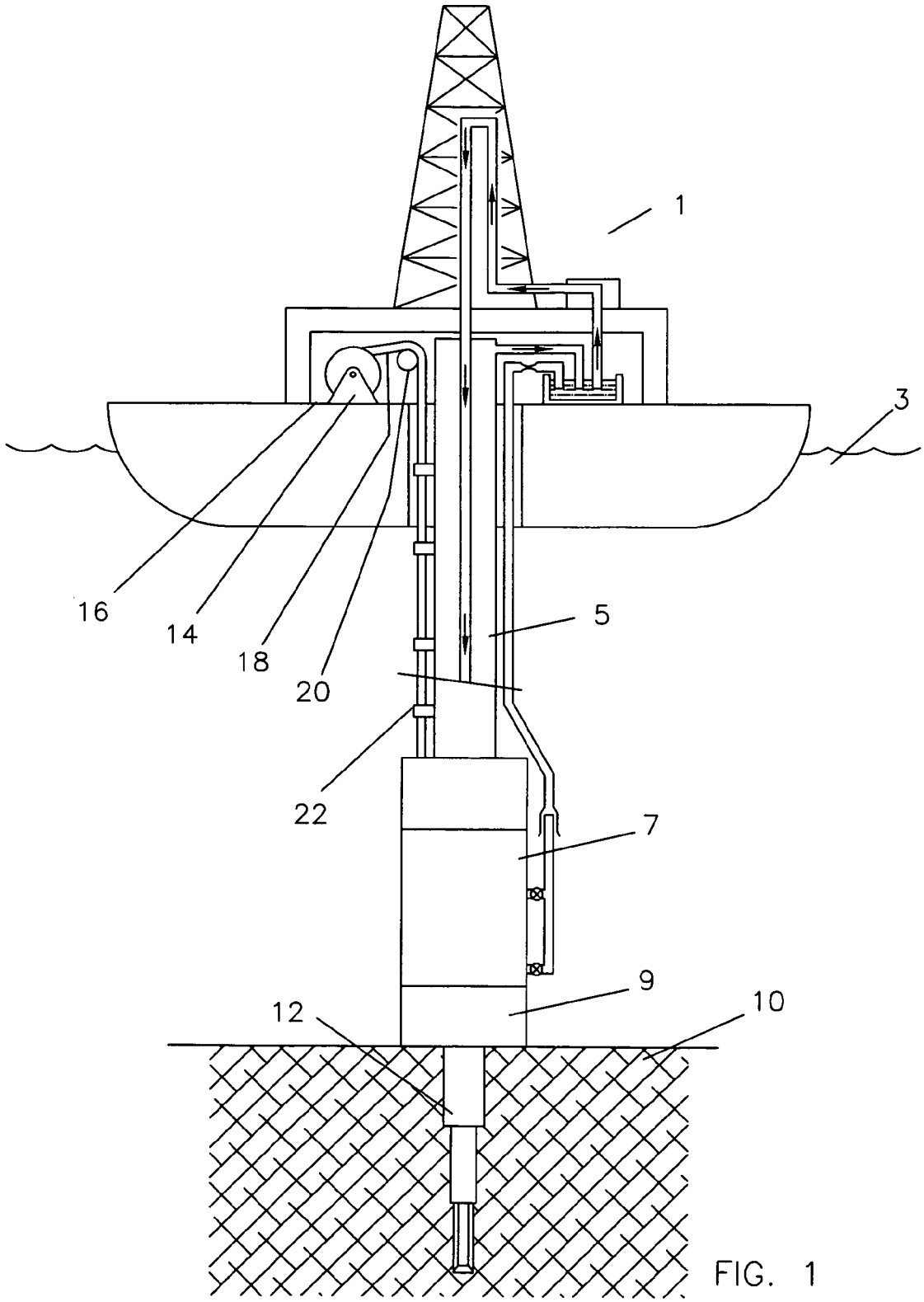
FIG. 1 is a view of a reel of this invention on the deck of a deepwater floating vessel, showing the umbilical clamped to a drilling riser.

FIG. 1 shows a vessel 1 floating on the ocean 3 and having a drilling riser 5 extending down toward a blowout preventer stack 7. The blowout preventer stack 7 is landed on a subsea wellhead 9 which is in turn landed on the seafloor 10. Casing 12 extends into the seafloor below the subsea wellhead 9 for the purpose of drilling an oil or gas well.

Reel 14 is setting on the deck 16 of vessel 1 with umbilical 18 extending over pulley or sheave 20 and going down the side of the riser 5. Riser 5 is a series of jointed pipes and as they are sequentially lowered into the ocean to lower the blowout preventer stack 7, clamps 22 clamp the umbilical 18 to the drilling riser 5. The blowout preventer stack 7 may weigh as much as 650,000 lbs. When it is lowered with the umbilical 18 attached, if the rotation of the reel 14 is stopped, the full 650,000 lb. load can be put on the umbilical, destroying it. An even worse consequence is that the pulley or sheave 20 can be pulled down from its mounting and land on personnel on the deck.

Figure 2:
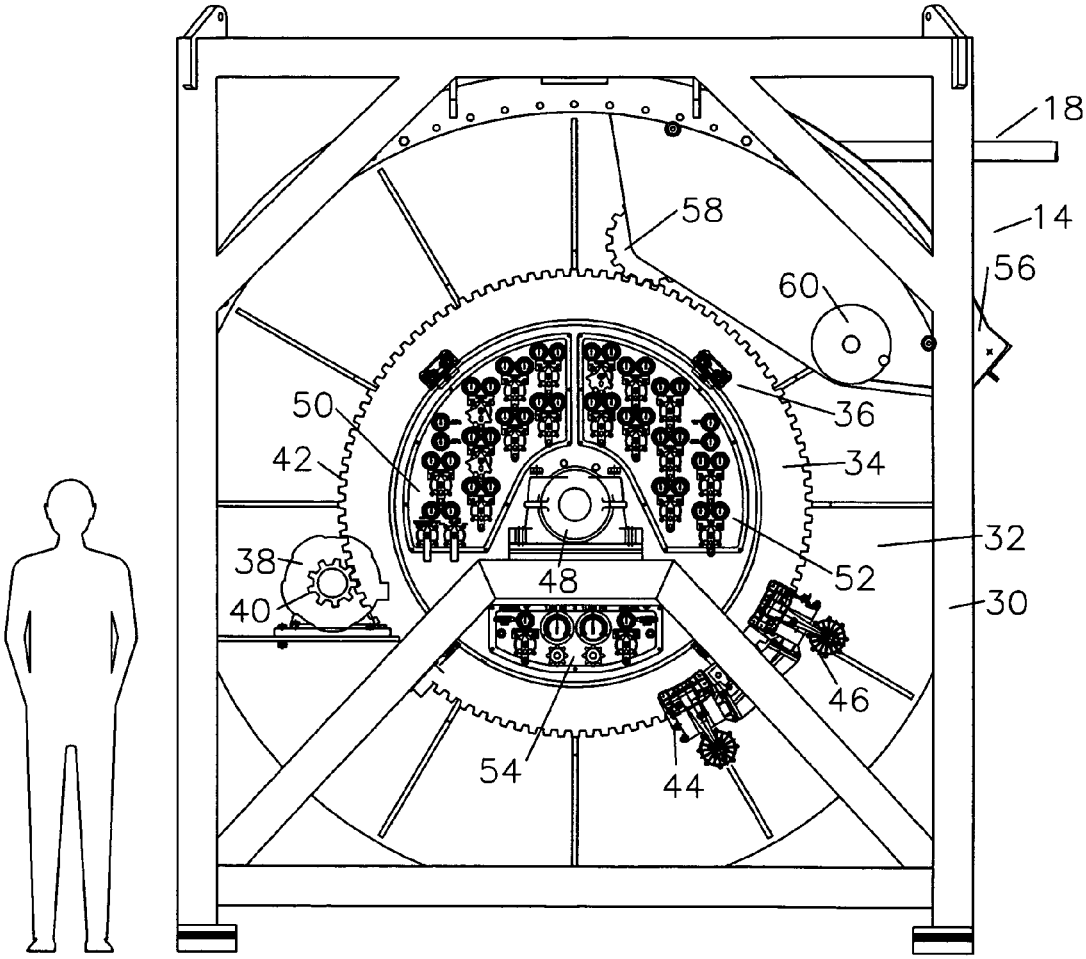
FIG. 2 is an end view of a reel of this invention.

Referring now to FIG. 2, reel 14 is shown with a frame 30 and a spool 32. Main disk 34 is shown mounted to the spool 32 by four slip assemblies 36. As will be seen later, the slip assemblies 36 provide a friction grip on the main disk 34, but will be allowed to slip when a large tension on the umbilical 18 is encountered.

Motor 38 is shown with gear 40 (shown through the motor for clarity) engaging the outer gear profile 42 on the perimeter of main disk 34. Gear 40 and the outer gear profile 42 are positively engaged such that if the motor 38 does not turn, the main disk 34 cannot rotate. Alternately, the connection between the motor and the main disk can be by roller chain and sprocket profiles.

Brake assemblies 44 and 46 are caliper or disk brake assemblies which are spring loaded into engagement and are air pressure released. If the air pressure is removed from these brakes, the brakes will close and the main disk 34 will not rotate about the centerline of spool 32.

Spool 32 rotates on main bearings 48. Panels 50, 52, and 54 provide valves for remote control functions along the umbilical. Levelwind 56 as will be seen in FIG. 3 has gear 58 to receive motive power from the main disk 34 and clutch handle 60 to allow for adjustment of the wrapping position of the umbilical.

Figure 3:
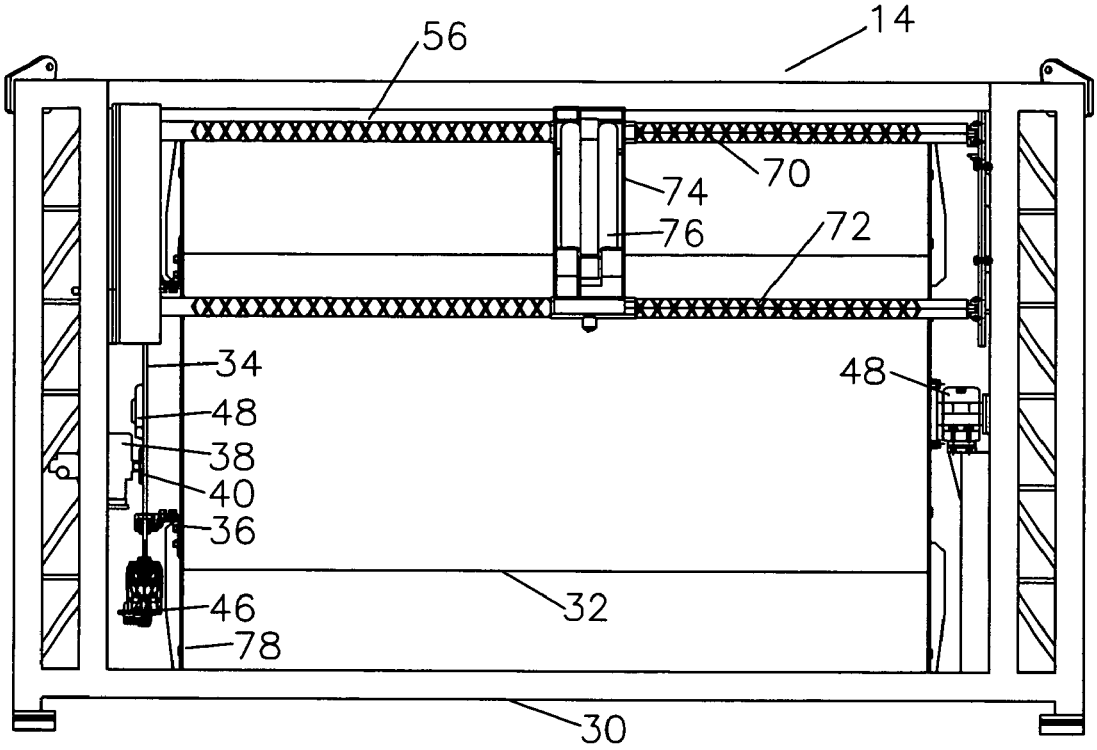
FIG. 3 is a front view of a reel of this invention.

Referring now to FIG. 3, levelwind 56 is shown having on a pair of diamond pattern screws 70 and 72 much like on an ordinary fishing reel. Level wind carriage 74 contains rollers 76 for controlling the position of the umbilical 18 (not shown) when it is being reeled in. Spool 32 has side flanges 78 and 79.

Figure 4:
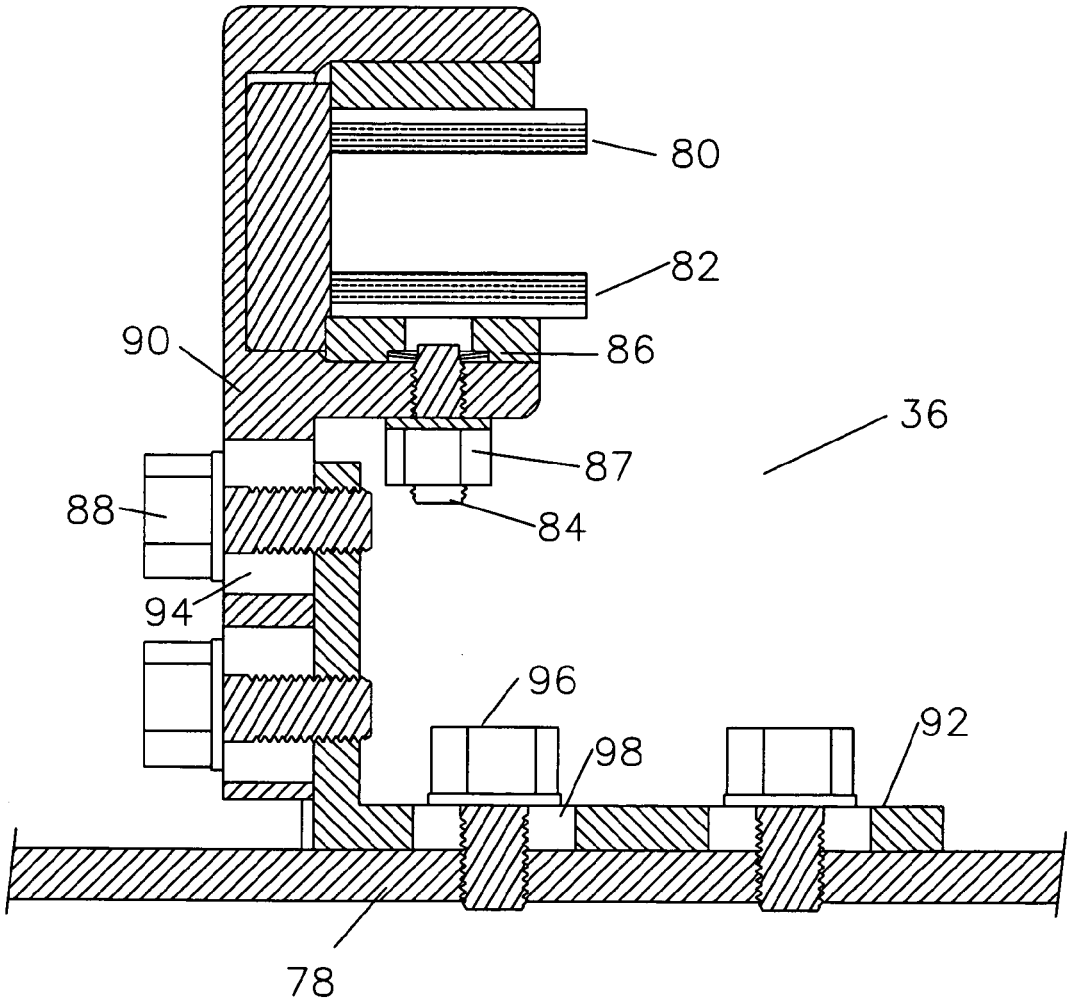
FIG. 4 is a section of a slip clamp of this invention.

Referring now to FIG. 4, a slip assembly 36 is shown with brake pads 80 and 82 which will be utilized to friction clamp onto the main disk 34. Screw 84 cooperated with conical spring 86 to preload the brake pads 80 and 82 onto the main disk 34. The torque on screws 84 can be adjusted to give a varying resistance to slippage depending on the required conditions. Nut 87 locks the position of bolt 84 when proper loading is achieved. Bolts 88 attach bracket 90 to bracket 92. Slots 94 allow for position adjustment of bracket 90 relative to bracket 92 in a first direction.

Bolts 96 bolt bracket 92 to the side 78 of spool 32. Slot 98 allows for adjustment of the slip assembly 36 along the surface of the side 78 of the spool 32 generally in a direction 90 degrees to the adjustment allowed by slots 94.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

The invention claimed is:

1. The method of preventing over tension to an umbilical wrapped on the spool of an offshore reel when said umbilical is unexpectedly pulled from said spool on said reel, comprising providing a main disk, mounting said main disk on the spool of said reel with a slip connection which will slip at a desired force, connecting motor power for said reel to said main disk, connecting brakes to said main disk, such that when tension from said umbilical exceeds a desired force due to restraint of said motor or said brakes, said slip connection will slip and prevent said umbilical from being subjected to tension higher than said desired amount said main disk is a circular plate with a sprocket profile on the perimeter and said motor is connected to said main disk by a chain.

2. The method of claim 1, further comprising said main disk is a circular plate with a gear profile on the perimeter.

3. The method of claim 1, further comprising power to drive levelwind movement is transmitted from said motor to said levelwind by said main disk.

4. The method of claim 1, further comprising said desired force for slipping can be adjusted.

5. The method of claim 4, further comprising said desired force for slipping is adjusted by rotating a screw.

6. The method of claim 4, further comprising that adjusting said desired force includes a spring.

7. The method of allowing slippage on the connection between a spool and a reel frame comprising;

providing a main disk, mounting said main disk on the spool of said reel with a slip connection which will slip at a desired force, connecting motor power for said reel to said main disk, connecting brakes to said main disk, such that when tension from said umbilical exceeds a desired force due to restraint of said motor or said brakes, said slip connection will slip and prevent said umbilical from being subjected to tension higher than said desired amount said main disk is a circular plate with a sprocket profile on the perimeter and said motor is connected to said main disk by a chain.

8. The method of claim 7, further comprising said main disk is a circular plate with a gear profile on the perimeter.

9. The method of claim 7, further comprising power to drive levelwind movement is transmitted from said motor to said levelwind by said main disk.

10. The method of claim 7, further comprising said desired force for slipping can be adjusted.

11. The method of claim 10, further comprising said desired force for slipping is adjusted by rotating a screw.

12. The method of claim 10, further comprising that adjusting said desired force includes a spring.

13. The method of releasing the spool of a reel to allow the umbilical on the reel to be paid off when the brakes and motor are locked, comprising providing a main disk, mounting said main disk on the spool of said reel with a slip connection which will slip at a desired force, connecting motor power for said reel to said main disk, connecting brakes to said main disk, such that when tension from said umbilical exceeds a desired force due to restraint of said motor or said brakes, said slip connection will slip and prevent said umbilical from being subjected to tension higher than said desired amount said main disk is a circular plate with a sprocket profile on the perimeter and said motor is connected to said main disk by a chain.

14. The method of claim 1, further comprising said main disk is a circular plate with a gear profile on the perimeter.

15. The method of claim 1, further comprising power to drive levelwind movement is transmitted from said motor to said levelwind by said main disk.

16. The method of claim 1, further comprising said desired force for slipping can be adjusted.

17. The method of claim 4, further comprising said desired force for slipping is adjusted by rotating a screw.

* * * * *